United States Patent [19]

McConnell

[11] 4,078,664

[45] Mar. 14, 1978

[54] CROSS BAR

[75] Inventor: Kennedy McConnell, Homewood, Ill.

[73] Assignee: Interlake, Inc., Oak Brook, Ill.

[21] Appl. No.: 781,172

[22] Filed: Mar. 25, 1977

[51] Int. Cl.[2] ..... A47F 5/00

[52] U.S. Cl. ..... 211/189; 108/111; 108/159; 211/187; 403/230

[58] Field of Search ..... 211/182, 184, 189, 186, 211/183, 191, 208; 52/664, 668, 507; 403/230, 242, 246; 108/111, 114, 155, 159

[56] References Cited

U.S. PATENT DOCUMENTS

| | | | |
|---|---|---|---|
| 2,815,130 | 12/1957 | Franks | 211/182 X |
| 3,018,862 | 1/1962 | Litteral et al. | 211/186 X |
| 3,042,221 | 7/1962 | Rasmussen | 211/182 X |
| 3,094,848 | 6/1963 | Albrecht | 108/159 X |
| 3,142,386 | 7/1964 | Skubic | 211/182 X |
| 3,285,428 | 11/1966 | Scheck | 211/187 X |
| 3,349,924 | 10/1967 | Maurer et al. | 211/189 X |
| 3,463,325 | 8/1969 | Zagotta et al. | 211/187 X |
| 4,048,059 | 9/1977 | Evans | 108/155 |

*Primary Examiner*—Roy D. Frazier
*Assistant Examiner*—Robert W. Gibson, Jr.
*Attorney, Agent, or Firm*—Vogel, Dithmar, Stotland, Stratman & Levy

[57] ABSTRACT

A cross bar is provided for interconnecting two parallel spaced-apart beams of a rack construction, wherein each beam has an inner ledge having a plurality of longitudinally spaced-apart apertures therein. The cross bar is in the form of a rectangular open-bottom channel member with one leg longer than the other, the long leg being integral along the entire lower edge thereof with a laterally outwardly extending flange. Two notches are respectively formed in the flange predetermined short distances from the opposite ends thereof, with the portions of the flange between the notches and the adjacent ends defining tabs dimensioned for insertion into selected ones of the apertures in the beams so that the short leg of the cross bar will rest upon the beam ledges with the top of the cross bar disposed substantially horizontally, the inner edges of the beam ledges being accommodated in the cross bar notches.

19 Claims, 7 Drawing Figures

CROSS BAR

BACKGROUND OF THE INVENTION

The present invention relates to rack constructions for the storage of merchandise in warehouses or the like. More particularly, the invention relates to an improved beam and cross bar arrangement for such a rack construction, the invention specifically being an improvement in the type of pallet rack construction described in U.S. Pat. No. 3,042,221 issued to G. E. Rasmussen on July 3, 1962, and assigned to the assignee of the present invention.

The Rasmussen rack construction is characterized by ease of assembly of the beams to the support posts without the use of tools or fasteners. The Rasmussen beams are provided with inwardly facing ledges or shelves for respectively receiving the opposite ends of pallets to be supported on the beams or, alternatively, for receiving the opposite ends of slats or support bars on which pallets or other types of loads may by supported. Such rack arrangements are typically utilized in warehouses or the like and the loading and unloading of merchandise is typically accomplished by the use of forklift trucks. Since the support slats in the Rasmussen rack construction are not secured to the beams, they frequently are accidentally moved along the beams or are completely dislodged therefrom by forklift trucks during loading and unloading operations.

SUMMARY OF THE INVENTION

The present invention provides an improved cross bar member and the combination of the improved cross bar member with an improved beam member in a rack construction which avoids the difficulties of the prior art rack constructions, while maintaining the advantages thereof, particularly ease of assembly without the use of tools or fasteners.

It is an important feature of the present invention that the improved cross bar member is of simple and economical construction and includes a tab member for insertion into a complementary aperture in the associated beam for interconnecting the two to prevent accidental disengagement thereof by upward forces exerted on the cross bar.

Another important feature of the present invention is the provision of a cross bar member of the type set forth which comprises a platform having two legs, one of which carries the tab and the other of which is supported in use on the ledge of the beam.

It is another feature of this invention that one of the cross bar legs carries an outwardly extending flange along substantially the entire length thereof, the flange being notched adjacent to the end thereof so that the portion of the flange between the notch and the cross bar end defines the tab, with the notch accommodating the edge of the beam ledge to facilitate mounting of the cross bar.

In connection with the foregoing feature, it is another feature of this invention that the flanged leg is longer than the other leg so that the cross bar platform may be mounted substantially parallel to the beam ledges.

It is another important feature of the present invention to provide a combination of the cross bar as set forth above with an improved beam having a ledge with a plurality of longitudinally spaced-apart apertures therein for receiving the cross bar tabs.

These features are obtained and it is an important object of the present invention to achieve these advantages by providing a cross bar for interconnecting spaced-apart beams in a rack construction wherein each beam has an elongated ledge with a plurality of longitudinally spaced-apart apertures therein, the cross bar comprising an elongated platform adapted to span the beam ledges and having spaced apart suppport legs for supporting the platform in a mounted position on the ledges, and a mounting tab extending outwardly from one of the legs adjacent to one end thereof, the tab being dimensioned and arranged to fit within a selected one of the apertures in the beam ledges with the cross bar in the mounted position thereof to interlock the cross bar with the beams for preventing accidental dislodgement of the cross bar in use.

Further features of the invention pertain to the particular arangement of the parts of the cross bar and associated beam whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENTS

Figure 1:
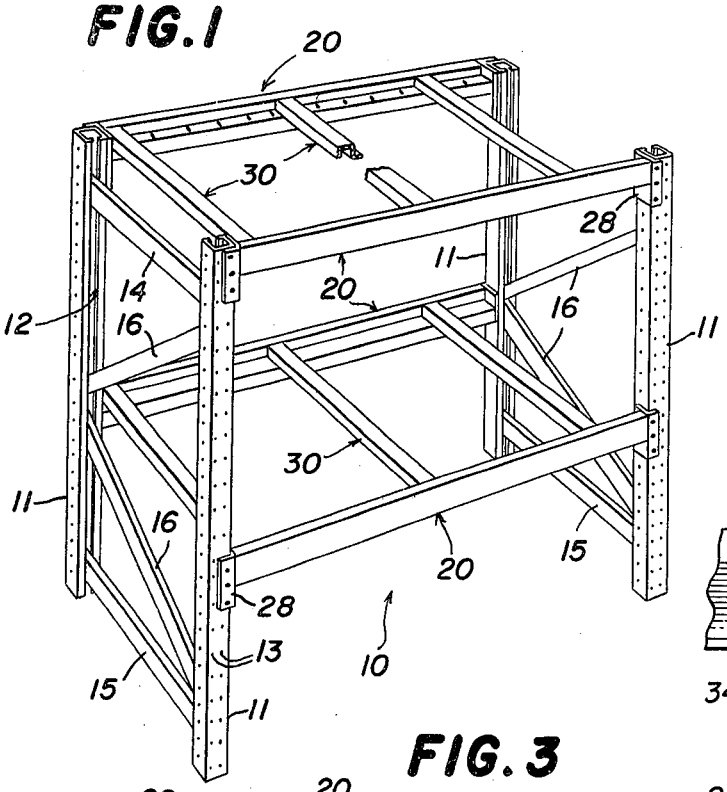
FIG. 1 is a perspective view of a rack construction utilizing cross bars constructed in accordance with and embodying the features of the present invention.
Figure 2:
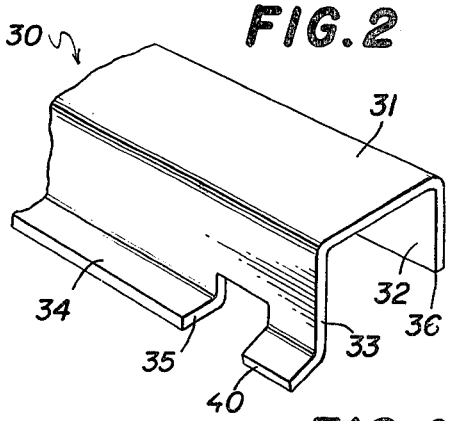
FIG. 2 is an enlarged fragmentary perspective view of the cross bar of the present invention.
Figure 4:
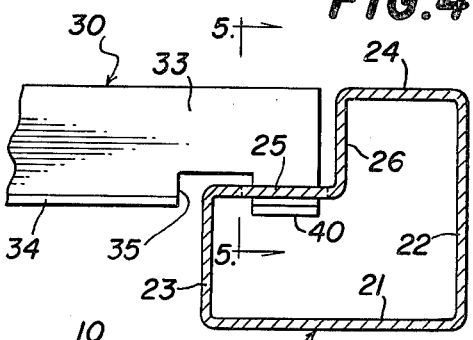
FIG. 4 is an enlarged fragmentary view in vertical section taken along the line 4-4 in FIG. 3, and illustrating the cooperation between the cross bar and beam of the present invention.
Figure 3:
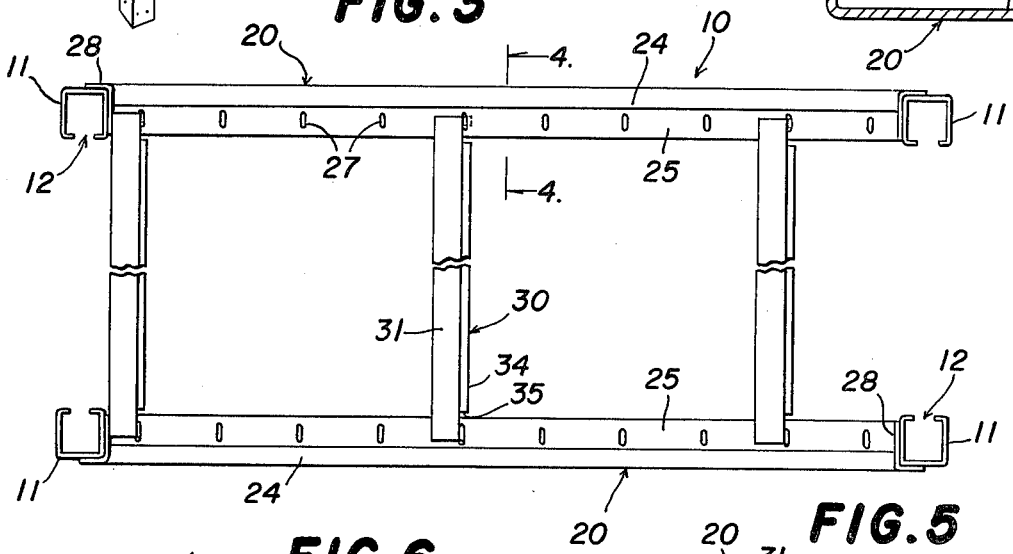
FIG. 3 is a top plan view of the rack construction illustrated in FIG. 1.
Figure 6:
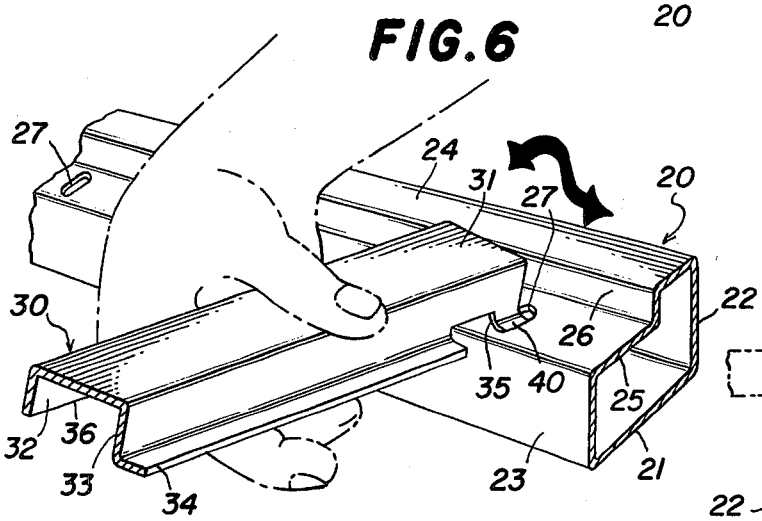
FIG. 6 is a fragmentary perspective view illustrating the technique for assembling the cross bar with the beam of the present invention.

Referring to FIG. 1 of the drawings, there is illustrated a rack generally designated by the numeral 10, which may be a pallet rack for the storage of pallets of merchandise thereon. The rack 10 is generally of the type illustrated in the aforementioned Rasmussen U.S. Pat. No. 3,042,221, and includes a plurality of upstanding posts 11, each of which is a generally rectangular tubular member having one wall thereof provided with a longitudinally extending slot 12 so that the post 11 is generally C-shaped in transverse cross section. Each of the other walls of each post 11 is provided with a plurality of longitudinally spaced-apart holes 13 therein. The posts 11 are arranged at the corners of a rectangular configuration, with the slots 12 of the front ones of the posts 11 respectively facing the slots 12 of the rear ones of the posts 11, the front posts 11 being respectively connected to the rear posts 11 by top and bottom brace members 14 and 15 and diagonal brace members 16, the opposite ends of each of the brace members 14–16 being respectively received in the slots 12 of the posts 11 and fixedly secured thereto by suitable means.

The front posts 11 are interconnected by elongated horizontally extending and vertically spaced-apart beams, each generally designated by the numeral 20, the rear posts 11 also being interconnected in like manner by additional beams 20. Referring also to FIGS. 2 through 6 of the drawings, each of the beams 20 is a hollow tubular member, the edges of which may be butt-welded or overlapped and spotwelded. Each beam 20 has a rectangular bottom wall 21 disposed in use substantially horizontally and respectively integral along the rear and front edges thereof with parallel upstanding outer and inner side walls 22 and 23, the outer side wall 22 having a vertical extent substantially greater than that of the inner side wall 23. Integral with the outer side wall 22 along the upper edge thereof is a top wall 24 which extends forwardly parallel to the bottom wall 21 but only partway toward the front edge thereof. Integral with the inner side wall 23 at the upper end thereof and extending rearwardly therefrom substantially parallel to the bottom wall 21 is a ledge 25 which terminates in an upstanding shoulder wall 26 which is disposed parallel to the side walls 22 and 23 and interconnects the adjacent ends of the top wall 24 and the ledge 25.

It will be appreciated that the ledge 25 and shoulder wall 26 cooperate to define a shelf in the beam 20. Formed in the ledge 25 is a plurality of longitudinally spaced-apart apertures 27, each of the apertures 27 being generally oval in shape and extending transversely of the ledge 25. Respectively fixedly secured to the opposite ends of the beam 20 as by welding are two mounting brackets 28 which are preferably with pins or lugs adapted to be received in the holes 13 of the posts 11, all as is more fully described in the aforementioned U.S. Pat. No. 3,042,221.

In use, the beams 20 are mounted on the posts 11 so that the ledges 25 face inwardly of the rack 10, with the beams 20 being arranged in pairs having the ledges thereof disposed in a common horizontal plane. Each such pair of ledges is adapted to be spanned by a plurality of cross bars, each generally designated by the numeral 30. Each cross bar 30 is generally in the form of a rectangular channel member having a flat rectangular bight portion 31 which defines a platform integral along one longitudinal edge thereof with an elongated rectangular leg 32 extending therefrom substantially normal thereto. Integral with the platform 31 along the other longitudinal edge thereof is an elongated rectangular leg 33 which extends substantially parallel to the leg 32 a predetermined distance beyond the distal edge 36 thereof so that, as viewed in transverse cross-section, the leg 33 is slightly longer than the leg 32. Integral with the leg 33 along the distal edge thereof and extending laterally outwardly therefrom at an angle thereto slightly greater than 90° is a rectangular flange 34.

Respectively formed in the flange 34 a short distance from each end thereof are two generally rectangular notches 35, each of the notches 35 extending upwardly a slight distance into the leg 33. The portions of the flange 34 between each end thereof and the adjacent notch 35 define two rectangular tabs 40 which have a length slightly less than the length of the apertures 27 in the beam ledges 25.

Thus, referring in particular to FIGS. 3 through 6, in use the cross bar 30 is placed in position spanning the beams 20 and substantially perpendicular to the longitudinal axes thereof with the tabs 40 respectively disposed in alignment with corresponding ones of the apertures 27 in the beam ledges 25. The width of each of the apertures 27 is substantially less than the lengths of the tabs 40. Therefore, in order to insert the tabs 40 into the apertures 27, the cross bar 30 must be tilted in a clockwise direction, as viewed in FIG. 6, insertion being facilitated by the slight downward inclination of the tabs 40. It will be noted that during the operation of inserting the tabs 40 into the apertures 27, the inner edges of the ledges 25 and the short inner side walls 23 of the beams 20 are accommodated in the notches 35. When the tabs 40 have been inserted into the apertures 27, the cross bar 30 is tilted back in a counterclockwise direction to the position illustrated in FIG. 5, wherein the upper surfaces of the tabs 40 are disposed beneath the inner or lower surfaces of the ledges 25, and the distal edge 36 of the short leg 32 of the cross bar is supported on the upper surfaces of the ledges 25. Because the leg 33 is longer than the leg 32, the platform 31 will be disposed substantially parallel to the ledges 25 when the cross bar 30 is disposed in the mounted configuration illustrated in FIG. 5. It will be appreciated that, when thus mounted, dislodgement of the cross bar 30 from the beams 20 by upward forces exerted on the cross bar 30 is prevented by engagement of the tabs 40 in the apertures 27.

Figure 5:
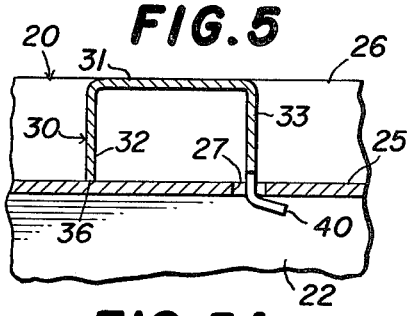
FIG. 5 is a fragmentary view in vertical section taken along the line 5—5 in FIG. 4.
Figure 5A:
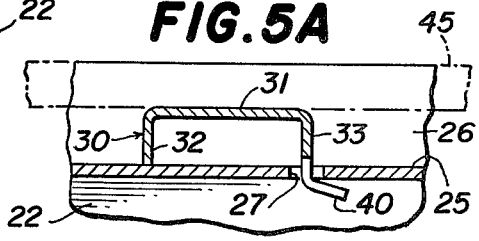
FIG. 5A is a view, similar to FIG. 5, showing an alternative form of the present invention wherein the tops of the beams and cross bars are not coplanar.

In the embodiment illustrated in FIGS. 1 through 6, the length of the leg 32 of the cross bar 30 is such that when disposed in the mounted configuration on the beams 20 as illustrated in FIG. 5, the upper surface of the platform 31 is substantially flush with the upper surface of the top walls 24 of the beams 20. If desired, the relationship of the heights of the cross bar 30 and beam shoulder 26 may be made such that the shoulder 26 extends upwardly well above the cross bar platform 31, as illustrated in FIG. 5A. In that case, a flooring material such as a sheet 45 of plywood or the like may be supported on the platforms 31 of the cross bars 30 such that the upper surface of the flooring sheet will be substantially flush with the upper surfaces of the beam top walls 24 to provide a continuous deck for storing merchandise thereon.

Preferably, the beams 20 and cross bars 30 of the present invention are formed of metal such as steel, but it will be appreciated that they may be formed of any suitable material which is sufficiently rigid and strong to perform the intended function.

From the foregoing, it can be seen that there has been provided a novel rack construction including beams having apertured ledges and cross bars adapted to span and be supported on the beam ledges.

More particularly, there has been provided a unique cross bar construction which includes tabs at the opposite ends thereof for respectively being received in corresponding apertures in the beams for interlocking the beams and the cross bars to prevent accidental dislodgement of the latter in use.

In addition, there has been provided a unique cross bar member which is of simple and economical construction and is such that when disposed in a mounted configuration on the beams it presents a substantially flat horizontal platform surface for the mounting of pallets or other types of objects thereon.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. A cross bar for interconnecting spaced-apart beams in a rack construction wherein each beam has an elongated ledge with a plurality of longitudinally spaced-apart apertures therein, said cross bar comprising an elongated platform adapted to span the beam ledges and having spaced-apart support legs for supporting said platform in a mounted position on the ledges, and a mounting tab extending outwardly from one of said legs adjacent to one end thereof, said tab being dimensioned and arranged to fit within a selected one of the apertures in the beam ledges with said cross bar in the mounted position thereof to interlock said cross bar with the beams for preventing accidental dislodgement of said cross bar in use.

2. The cross bar set forth in claim 1, wherein said one leg has two of said mounting tabs extending outwardly therefrom respectively adjacent to the opposite ends thereof.

3. The cross bar set forth in claim 1, wherein said platform is substantially flat and rectangular in shape.

4. The cross bar set forth in claim 1, wherein said support legs are substantially parallel to each other, with said one leg extending from said body further than the other of said legs.

5. A cross bar for interconnecting spaced-apart beams in a rack construction wherein each beam has an elongated ledge with a plurality of longitudinally spaced-apart apertures therein, said cross bar comprising an elongated platform adapted to span the beam ledges and having first and second elongated spaced-apart support legs extending therefrom substantially normal thereto along substantially the entire length thereof, a flange carried by said first leg and extending laterally outwardly therefrom along substantially the entire length thereof, said flange having a notch formed therein a predetermined short distance from one end thereof with the portion of said flange between said one end and said notch defining a tab, said tab being dimensioned and arranged for insertion into a selected one of the apertures in the beam ledges to a mounting configuration wherein the upper surface of said tab is disposed beneath the lower surface of the ledge and the bottom edge of said second leg is supported upon the ledge and the inner edge of the ledge is accommodated in the notch, whereby said cross bar is interlocked with the beam for preventing accidental dislodgement of said cross bar in use.

6. The cross bar set forth in claim 5, wherein said flange has two of said notches respectively formed therein predetermined short distances from the opposite ends thereof, with the portions of said flanges between said ends and said notches respectively defining two of said tabs.

7. The cross bar set forth in claim 5, wherein said platform is substantially flat and rectangular in shape.

8. A cross bar for interconnecting spaced-apart beams in a rack construction wherein each beam has an elongated ledge with a plurality of longitudinally spaced-apart apertures therein, said cross bar comprising an elongated platform adapted to span the beam ledges and having first and second elongated spaced-apart support legs extending therefrom substantially normal thereto along substantially the entire length thereof, said first leg extending further from said platform than said second leg, a flange carried by said first leg at the distal end thereof and extending laterally outwardly therefrom along substantially the entire length thereof, said flange having a notch formed therein a predetermined short distance from one end thereof with the portion of said flange between said one end and said notch defining a tab, said tab being dimensioned and arranged for insertion into a selected one of the apertures in the beam ledges to a mounting configuration wherein the upper surface of said tab is disposed beneath the lower surface of the ledge and the bottom edge of said second leg is supported upon the ledge and the inner edge of the ledge is accommodated in the notch, the lengths of said first and second legs being such that when said cross bar is disposed in the mounting configuration thereof said platform is disposed substantially parallel to said ledges, whereby said cross bar is interlocked with the beam for preventing accidental dislodgement of said cross bar in use.

9. The cross bar set forth in claim 8, wherein said first and second support legs are substantially parallel to each other.

10. The cross bar set forth in claim 8, wherein said platform is substantially flat and rectangular in shape and is disposed substantially parallel to said flange.

11. The cross bar set forth in claim 8, wherein the extent of each of said tabs laterally of said flange is substantially greater than the widths of the beam apertures, whereby said flange must be tilted on an angle with the beam ledge to accommodate insertion of said tabs into the apertures.

12. The cross bar set forth in claim 8, wherein said flange extends from said first leg at an obtuse angle thereto.

13. The cross bar set forth in claim 8, wherein said notch extends a predetermined slight distance into said first leg toward said platform.

14. In a rack construction, the combination comprising a pair of elongated spaced-apart beams, each of said beams including an elongated generally rectangular ledge and an elongated shoulder extending upwardly from said ledge substantially normal thereto along substantially the entire length thereof, said ledge having a plurality of longitudinally spaced-apart apertures therein; and a cross bar including an elongated platform adapted to span said beam ledges and having first and second elongated spaced-apart support legs extending therefrom substantially normal thereto along substantially the entire length thereof, said first leg extending further from said platform than said second leg, and a flange carried by said first leg at the distal end thereof and extending laterally outwardly therefrom along substantially the entire length thereof, said flange having a notch formed therein a predetermined short distance from one end thereof with the portion of said flange between said one end and said notch defining a tab, said tab being dimensioned and arranged for insertion into a selected one of the apertures in said beam ledges to a mounting configuration wherein the upper surface of said tab is disposed beneath the lower surface of said ledge and the bottom edge of said second leg is supported upon said ledge and the inner edge of said ledge is accommodated in said notch; the lengths of said first and second legs being such that when said cross bar is disposed in the mounting configuration thereof said platform is disposed substantially parallel to said ledges, whereby said cross bar is interlocked with said beam for preventing accidental dislodgement of said cross bar in use.

15. The combination set forth in claim 14, wherein the upper surface of said platform in the mounting configuration of said cross bar is substantially coplanar with the upper edge of said shoulder on said beam.

16. The combination set forth in claim 14, wherein the upper surface of said platform in the mounting configuration of said cross bar is disposed a predetermined distance below the upper edge of said shoulder on said beam.

17. The combination set forth in claim 14, wherein each of said apertures in said beam is generally oval in shape and extends substantially transversely of said ledge.

18. The combination set forth in claim 14, wherein said beam comprises a hollow tubular member.

19. The combination set forth in claim 14, wherein each of said apertures in said beam is generally oval in shape and extends substantially transversely of said ledge, each of said tabs having an extent laterally of said flange substantially greater than the widths of said apertures, whereby said flange must be tilted on an angle with said beam ledge to accommodate insertion of said tabs into said apertures.

* * * * *